US005756212A

United States Patent [19]

Liebler et al.

[11] Patent Number: 5,756,212

[45] Date of Patent: May 26, 1998

[54] RECORDING MATERIAL

[75] Inventors: Ralf Liebler, Kreuzau; Peter Koch, Cologne, both of Germany

[73] Assignee: Sihl GmbH, Duren, Germany

[21] Appl. No.: 682,622

[22] PCT Filed: Mar. 24, 1995

[86] PCT No.: PCT/EP95/01105

§ 371 Date: Jul. 18, 1996

§ 102(e) Date: Jul. 18, 1996

[87] PCT Pub. No.: WO95/28284

PCT Pub. Date: Oct. 26, 1995

[30] Foreign Application Priority Data

Apr. 14, 1994 [DE] Germany ..... 44 12 817.7
Jul. 27, 1994 [DE] Germany ..... 44 26 578.6

[51] Int. Cl.[6] ..... B41M 5/00

[52] U.S. Cl. ..... 428/409; 428/195; 428/209; 428/500

[58] Field of Search ..... 428/195, 209, 428/409, 500; 347/105

[56] References Cited

U.S. PATENT DOCUMENTS

| | | | |
|---|---|---|---|
| 4,664,952 | 5/1987 | Arai | 427/256 |
| 4,956,223 | 9/1990 | Arai | 428/212 |
| 5,612,281 | 3/1997 | Kobayashi et al. | 503/227 |

FOREIGN PATENT DOCUMENTS

| | | | |
|---|---|---|---|
| 0 483 798 | 5/1992 | European Pat. Off. . | |
| 0 524 626 A1 | 1/1993 | European Pat. Off. . | |
| DIN 67530 | 1/1982 | Germany | 428/195 |
| 35 37 706 C2 | 7/1988 | Germany . | |
| 55-071586 | 5/1980 | Japan . | |
| 6048025 | 2/1994 | Japan . | |
| WO 92/07723 | 5/1992 | WIPO . | |
| WO 93/04869 | 3/1993 | WIPO . | |

*Primary Examiner*—Bruce H. Hess
*Attorney, Agent, or Firm*—Baker & Daniels

[57] ABSTRACT

The invention relates to a recording material for the inkjet method having a particularly glossy surface, a substrate material having a metal layer on at last one of its surfaces and it being possible for this metal layer additionally to be provided with a protective layer. The material thus obtained carries an ink-accepting layer on one of the following surfaces: 1. on the metal layer, 2. on the protective layer cover the metal layer, 3. on that surface of the substrate material which faces away from the metal layer. When an image is recorded on the ink-accepting layer on a commercial inkjet plotter, particularly interesting reflecting color effects are obtained, in particular colors such as silver, gold, golden red, etc. being produced, which are not achievable by means of a conventional inkjet recording method.

19 Claims, No Drawings

RECORDING MATERIAL

The invention relates to an improved recording material to meet the requirements of the inkjet process.

Such recording material are known in principle. They are paper or transparent or dull plastics films. These materials, in particular the plastics films, carry an ink-accepting layer on at least one of their surfaces. These are generally hydrophilic coatings which are applied to the substrate in a thickness of between 2 and 50 μm. Such layers are particularly suitable for accepting the generally aqueous inks.

WO 92/07723 describes the coating of a substrate material with a mixture of a crosslinkable and a liquid-absorbing polymer, a partially permeable network being formed in the layer after complete reaction of the said polymers.

WO 93/04869 discloses an ink-accepting layer which is composed of the following components: (1) a vinylpyrrolidone, (2) a polyester, (3) an alkylene oxide polymer, (4) a polyvinyl alcohol and (5) a polyether. The layer exhibits particularly good acceptance properties for aqueous inks.

EP-A-524 626 describes a recording material having a layer which consists mainly of porous pseudoboehmite. This coating has the advantage of particularly rapid drying of the ink.

The use of coloured inks in addition to black ink has become established in the production of recordings, in particular image recordings. A wide range of colour effects is achievable by suitable mixing of the primary colours cyan, magenta, yellow and black. In some cases (graphics, advertising, labels), particularly glossy, reflecting colour effects are desirable. Such effects are not achievable by means of conventional known recording materials.

It is the object of the invention to provide a recording material for inkjet processes on which particularly glossy recordings and/or colour effects are achievable with conventional inks.

This object is achieved by an ink-jet recording material having a substrate material which has a metal layer at least on one of its surfaces and has on this metal layer a transparent or slightly dull recording layer for accepting aqueous inks, the gloss measured on the surface of this recording layer according to DIN 67530 having a value >70% when measured at an angle of 20°, 60° and 85° against the standard gloss master (standard A).

It is usual to measure the gloss at different angles, depending on the gloss. Relatively dull surfaces are usually measured at 85° and more highly glossy surfaces at 20°. The recording material according to the invention has a gloss of more than 70%, preferably of more than 80%, at all conventional measuring angles. A gloss of more than 90% at the measuring angles 60° and 85° and more than 85% at a measuring angle of 20° is very particularly preferred.

The gloss of the recording material is measured on the recording layer according to DIN 67530 using commercial gloss measuring apparatuses, for example by means of an apparatus obtainable under the name "detectometer" from the company Dr. Lange. The measurement is carried out against the standard gloss master (standard A).

To achieve this gloss of the recording material, the transparent substrate material is provided with a smooth reflecting metal layer on at least one surface by any dessired method. Suitable preferred metals are aluminium, zinc, nickel, chromium, copper, gold, silver or the alloys thereof. The application is preferably effected by vapour deposition at reduced pressure or by cathode sputtering over the substrate material arranged in a chamber. The metal layer may also be composed of several individually applied layers in order to obtain the desired thickness. The thickness of the metal layer is preferably 10 nm to 300 nm.

Preferably the metal layer is covered by a protective coating and the transparent or slightly dull recording layer for acepting aqueous inks is positioned on said protective layer.

In order to achieve the desired effect of the metal layer on the surface gloss of the recording layer, the substrate material should have as smooth a surface as possible. This can be achieved by means of a coating on a substrate material, for example paper. A particularly suitable transparent substrate material comprises plastics films of thermoplastic polymers, for example polyester films. Transparent papers are also suitable as substrate material.

In the event of a transparent substrate said substrate may have a metal layer on one of its surfaces and the transparent or slightly dull recording layer for accepting aqueous inks is positioned on the opposite surface of the transparent substrate material instead on the metal layer or on the protective coating covering the metal layer.

Suitable polymers for the protective layer are, for example, poly(meth)acrylates, polyvinyl acetates or copolymers thereof.

The transparent recording layer for inks contains a hydrophilic film-forming polymer. Suitable polymers are polyvinyl alcohol (PVA), polyvinylpyrrolidone (PVP), cellulose derivatives, (meth)acrylic acid derivatives, polyvinyl acetate or copolymers thereof and mixtures of such substances. The recording layer may have a thickness of 2 μm to 50 μm.

This transparent recording layer for inks can, according to the invention, be applied to the following surfaces:

1. to the metal layer
2. to the protective layer covering the metal layer
3. in the case of transparent substrate material, optionally to that surface of the substrate material which faces away from the metal layer.

Since the adhesion of the recording layer to the metal layer is not completely sufficient in some cases, embodiments 2 and 3 are preferred.

In the case of embodiment 3, the effect of the metal layer also occurs through the transparent substrate material towards the surface of the recording layer.

EXAMPLES

Example 1

A 100 μm thick polyethylene terephthalate film is provided on one side with an about 50 nm thick aluminium layer by vapour deposition at reduced pressure. The other surface of the film is then coated with the following solution:

Coating composition:

85 kg of water 15 kg of polyvinylpyrrolidone (PVP)

This coating solution is applied with the aid of a 0.8 mm wire-wound doctor to that surface of the film which faces away from the metal layer and is then dried for 2 minutes at 160°. The resulting coating weight of this ink-accepting layer is about 9 g/m$^2$. The recording of an image on this final layer on a commercial inkjet plotter, for example Canon BJC 800, gives particularly interesting reflecting colour effects, in particular colours such as silver, gold, golden red, etc. being produced, which are not achievable by means of a conventional inkjet recording method.

Example 2

A 100 μm thick polyethylene terephthalate film is provided with an aluminium layer by vapour deposition in the same manner as in Example 1. The coating solution described in Example 1 is then applied to this aluminium layer in the same manner. Here too, recording of an image gives the same interesting colour effects.

Example 3

A polyethylene terephthalate film is coated by vapour deposition on one side in the same manner as in Example 1. The following protective coating is then applied to this metal layer:

Coating composition:

75 kg of methyl ethyl ketone 10 kg of propylene glycol methyl ether 15 kg of commercial acrylate polymer (solid)

This coating solution is applied to the metal layer by means of a 0.4 mm wire-wound doctor and then dried for about 2 minutes at 160° C. The resulting coating weight of this second layer is about 1.5 g. The ink-accepting layer is applied to this second layer as described in Example 1. Here too, recording of an image on this final layer on a commercial inkjet plotter gives the same reflecting colour effects.

We claim:

1. Ink-jet recording material having a substrate material which has a metal layer at least on one of its surfaces and has on this metal layer a transparent or slightly dull recording layer for accepting aqueous inks, the gloss measured on the surface of this recording layer according to DIN 67530 having a value >70% when measured at an angle of 20°, 60° and 85° against the standard gloss master standard A.

2. Recording material according to claim 1, characterized in that the metal layer is covered by a protective coating and the transparent or slightly dull recording layer for accepting aqueous inks is positioned on said protective layer.

3. Recording material according to claim 1, characterized in that the substrate material is transparent.

4. Recording material according to claim 3, characterized in that the substrate is a plastics film.

5. Recording material according to claim 2, characterized in that the protective layer is a (meth)acrylate polymer or copolymer.

6. Recording material according to claim 2, characterized in that the substrate material is transparent.

7. Recording material according to claim 2, characterized in that the substrate is a plastics film.

8. Recording material according to claim 2, characterized in that the metal layer contains aluminum, zinc, copper, nickel, chromium, gold, silver or alloys thereof.

9. Recording material according to claim 1, characterized in that the gloss has a value >80% at an angle of 20°, 60° and 85° against the standard gloss master standard A.

10. Recording material according to claim 9, characterized in that the substrate is a plastics film.

11. Recording material according to claim 1, characterized in that the gloss has a value >90% at an angle of 60° and 85° and a value >85% at an angle of 20° against the standard gloss master standard A.

12. Recording material according to claim 11, characterized in that the substrate is a plastics film.

13. Recording material according to claim 1, characterized in that the substrate is a plastics film.

14. Recording material according to claim 1, characterized in that the metal layer contains aluminum, zinc, copper, nickel, chromium, gold, silver or alloys thereof.

15. Recording material according to claim 1, characterized in that the substrate material is a transparent polyester film.

16. Recording material according to claim 1, characterized in that the transparent or slightly dull recording layer comprises a hydrophilic film-forming polymer.

17. Recording material according to claim 16, characterized in that the hydrophilic film-forming polymer consists of PVA, PVP, cellulose derivatives, (meth)acrylic acid derivatives, vinyl acetate, copolymers thereof or a mixture of these substances.

18. Ink jet recording material having a transparent substrate material having two surfaces, a metal layer disposed on one of said surfaces, said metal layer covered by a protective coating, and a transparent or slightly dull recording layer for accepting aqueous inks disposed on said substrate surface opposite that on which said metal layer is disposed, the gloss measure on the surface of said recording layer according to DIN 67530 having a value >70% when measured at an angle of 20°, 60° and 85° against the standard gloss master standard A.

19. Recording material according to claim 18, characterized in that said substrate is a plastics film.

* * * * *